US006855054B2

(12) United States Patent
White et al.

(10) Patent No.: US 6,855,054 B2
(45) Date of Patent: Feb. 15, 2005

(54) GAMING METHODS AND APPARATUS USING INTERCHANGEABLE SYMBOLS

(75) Inventors: Michael L. White, Las Vegas, NV (US); John C. Philipp, Sonoma, CA (US); Julie A. Mottes, Henderson, NV (US); Brian A. Johnson, Las Vegas, NV (US); James M. Coleman, Reno, NV (US)

(73) Assignee: IGT, Reno, NV (US)

( * ) Notice: Subject to any disclaimer, the term of this patent is extended or adjusted under 35 U.S.C. 154(b) by 62 days.

(21) Appl. No.: 10/036,092

(22) Filed: Nov. 9, 2001

(65) Prior Publication Data

US 2003/0092480 A1 May 15, 2003

(51) Int. Cl.[7] ..... A63F 9/24

(52) U.S. Cl. ..... 463/21; 463/42; 273/139

(58) Field of Search ..... 463/16–21, 25, 463/30, 36; 273/138.1, 139, 153 R, 153 S

(56) References Cited

U.S. PATENT DOCUMENTS

| | | | | | |
|---|---|---|---|---|---|
| 4,099,722 | A | | 7/1978 | Rodesch et al. | |
| 4,200,291 | A | | 4/1980 | Hooker | |
| 4,636,951 | A | * | 1/1987 | Harlick | 463/25 |
| RE34,244 | E | | 5/1993 | Hagiwara | |
| 5,564,700 | A | | 10/1996 | Celona | |
| 5,704,835 | A | | 1/1998 | Dietz, II | |
| 5,720,662 | A | | 2/1998 | Holmes, Jr. et al. | |
| 5,769,716 | A | | 6/1998 | Saffari et al. | |
| 5,807,172 | A | | 9/1998 | Piechowiak | |
| 5,951,397 | A | * | 9/1999 | Dickinson | 463/36 |
| 5,980,384 | A | * | 11/1999 | Barrie | 463/16 |
| 6,089,977 | A | * | 7/2000 | Bennett | 463/20 |
| 6,117,013 | A | | 9/2000 | Eiba | |
| 6,224,484 | B1 | | 5/2001 | Okuda et al. | |
| 6,227,971 | B1 | * | 5/2001 | Weiss | 463/20 |
| 6,241,607 | B1 | * | 6/2001 | Payne et al. | 463/20 |
| 6,251,013 | B1 | * | 6/2001 | Bennett | 463/13 |
| 6,409,602 | B1 | * | 6/2002 | Wiltshire et al. | 463/42 |
| 6,419,579 | B1 | * | 7/2002 | Bennett | 463/20 |
| 2002/0077165 | A1 | * | 6/2002 | Bansemer et al. | 463/7 |
| 2003/0054874 | A1 | * | 3/2003 | Kaminkow | 463/20 |
| 2003/0057645 | A1 | * | 3/2003 | Baerlocher | 273/138.2 |
| 2003/0060267 | A1 | * | 3/2003 | Glavich | 463/20 |

FOREIGN PATENT DOCUMENTS

| | | | | | |
|---|---|---|---|---|---|
| EP | 58488 | A1 | * | 8/1982 | G07F/17/34 |
| EP | 1 063 622 | A2 | | 12/2000 | |
| GB | 1 454 046 | | | 10/1976 | G07F/17/34 |
| GB | 2 062 922 | | | 5/1981 | G07F/17/34 |
| GB | 2097160 | A | * | 10/1982 | G07F/17/34 |
| GB | 2106295 | A | * | 4/1983 | G07F/17/34 |
| GB | 2165385 | A | * | 4/1986 | G07F/17/34 |

* cited by examiner

*Primary Examiner*—Derris H. Banks
*Assistant Examiner*—Alex F. R. P. Rada, II
(74) *Attorney, Agent, or Firm*—Marshall, Gerstein & Borun LLP

(57) ABSTRACT

Methods of playing games of chance and gaming devices and systems comprising a display of a plurality of symbols where at least one symbol may be interchanged with another symbol of the plurality of symbols. After a combination of symbols is randomly generated and the results are displayed to a player, the player may have the opportunity to interchange at least one displayed symbol with another symbol in order to configure a more advantageous symbol arrangement. Interchanging may include transposing, sliding, or moving one or more symbols that are generated by way of a random process. Furthermore, interchanging may include a slide game or wraparound type movement of symbols or trading a symbol for another symbol provided by an exterior source. Additionally, the interchanging opportunity may be limited by way of constraints applied to movement of the symbols, time for interchanging, or other criteria, and may be conditioned on placing an additional or side bet.

14 Claims, 10 Drawing Sheets

GAMING METHODS AND APPARATUS USING INTERCHANGEABLE SYMBOLS

BACKGROUND OF THE INVENTION

1. Field of the Invention

This invention relates generally to a method and apparatus for playing games of chance. More specifically, the invention encompasses a method and apparatus for gaming that integrates the elements of a visual presentation of multiple independent physical shapes with the elements of a game of chance. The gaming method of the present invention may be implemented in a stand-alone gaming machine, a stand-alone gaming machine including a bonus event, networked gaming machines in a progressive game, or networked gaming machines in the context of a cooperative and/or competitive multiplayer participation game.

2. State of the Art

Gaming machines have long been a significant facet of the gaming industry. One of the most basic implementations of a gaming machine is an electromechanical device employing a set of laterally adjacent spinning reels, commonly known in the art as a "slot" machine. Electronic implementations of these gaming machines using video displays simulating spinning reels have also gone into widespread use in recent years. During typical operation of one of these gaming machines, a player wagers an amount and invokes spinning (or simulation of spinning) of a set of reels displaying symbols on their outer surface. At the conclusion of rotation, each reel is stopped at a random rotational position, the reels together displaying an array of symbols aligned along one or more paths, commonly termed "pay lines". If a predetermined combination of symbols is aligned on a pay line when all of the reels have stopped, then the player is awarded an amount that is substantially proportional to the probability of the occurrence of the combination of symbols.

Unfortunately, play on conventional reel-type gaming machines becomes somewhat boring to a player after some time. As a consequence, the gaming market has recognized a demand for new and different gaming experiences to stimulate and maintain player appeal. Gaming machines that offer different modes of operation and different or additional gaming experiences are always desirable to attract players and maintain their interest in gaming. Thus, gaming machines have evolved which incorporate games designed to offer relatively high payoffs and to provide a variety of gaming experiences.

One conventional example of increasing possibilities for winning and thereby stimulating the interest of a player is by increasing the number of pay lines. Additional pay lines may provide the opportunity for a player to win a game in a number of different ways, through different symbols combinations along a number of different paths. Evaluation of all the different pay lines also increases player attention to the perceived complexity of the game and thus may maintain a player's interest. Therefore, the gaming industry has steadily increased the number of pay lines available in gaming machines, as discussed below.

U.S. Pat. No. 4,099,722 to Rodesch discloses a mechanical three-reel slot machine with three horizontal pay lines and two diagonal pay lines. Further, U.S. Pat. No. RE 34,244 to Hagiwara discloses the use of three horizontal pay lines, two diagonal pay lines, and three vertical pay lines by way of independent mechanical or electronic symbol generation for each of nine symbols in a three by three matrix of symbols. Additionally, U.S. Pat. No. 5,807,172 to Piechowiak discloses nine pay lines generated from a three by three matrix of nine symbols by way of three horizontal pay lines, two diagonal pay lines, and four multi-directional diagonal pay lines.

Another situation that players find interesting is the possibility of changing a losing gaming event into a winning event. Initial disappointment in the losing event may be diverted to examine the further possibility of changing the losing event into a winning event. Various "second chance" gaming devices and methods have been implemented into slot-type gaming machines, as discussed in more detail below.

U.S. Pat. No. 4,200,291 to Hooker allows a player to determine which reels may be held and which reels should be spun upon the pull of the handle. Such an option may give a player more satisfaction if a winning event occurs and also may maintain player interest by allowing a player some apparent control to configure a winning event.

Another variation for allowing players some perceived control of winning events involves the so-called "nudge" option. British Patent 2 062 922 discloses that, after an initial spin of the reels has been completed, the player is given the option to "nudge" one of the reels by rotationally indexing the reel up or down one or more positions in order to achieve a winning combination. By adjusting the payout tables of such a "nudge" game, the gaming establishment operating the gaming machine may still effect favorable odds.

British Patent 1 454 046 to Gatley analyzes the metered payout ratio of the machine and turns a cam either clockwise or counterclockwise to "tighten" or "loosen" the machine accordingly, either during or just prior to each game. Gatley teaches a payout metering invention that is intended for a "nudge" machine where the likelihood of a payout is determined not just by random draw, but also by the skill of the player in nudging the wheels forward or backward. The method of limiting payouts described in Gatley restricts the ability of the player to nudge the wheels.

U.S. Pat. No. 5,704,835 to Dietz discloses an example of a gaming machine and method employing a video display comprising a number of display boxes simulating reels that allows the possibility of transforming a losing event into a winning event by permitting a player to completely "respin" one or more of the display boxes after the first "spin" of all of the boxes.

While the gaming industry has progressively expanded the number of pay lines and enhanced the ability of the player to interact with the gaming device in order to capture and maintain player interest, it would be advantageous to provide a gaming machine with different types of player interaction and challenge as well as providing other, different opportunities for winning possibilities.

BRIEF SUMMARY OF THE INVENTION

The various embodiments of the present invention are directed to methods of playing games of chance and gaming machines for implementing such games, wherein the games of chance comprise reel type games incorporating video displays comprising a combination of symbols in a display matrix wherein at least one symbol may be interchanged with a different symbol by the player after the combination of symbols is generated and visually displayed in the matrix. Stated another way, the present invention provides a gaming machine where two individual symbols may be interchanged after a play sequence so that the first symbol occupies an initial position of the second symbol and the second symbol occupies an initial position of the first symbol, independent of the row, column, or position that each of the symbols may occupy. According to one embodiment of the present invention, symbols displayed to the player of differing positions may be interchanged.

In the present invention, symbols are configured into a matrix display for determining winning events along any selected number and configurations of pay lines. Play of the game of chance of the present invention may commence, as with any conventional gaming machine, with a placement of a wager by a player. A "play sequence," as the term may be used herein, describes the process between the beginning of the random selection process for the combination of symbols for display in the matrix and communication of the random selection process to the player in the form of the matrix display. The player may select pay lines, or use the gaming machine's default pay lines as selected by placement of varying size wagers. The player then initiates a request for initiation of a play sequence, wherein a random symbol configuration and arrangement is generated and then the display of initial symbols prior to initiation of the play sequence may be caused to perceptibly rotate, oscillate, transform, or otherwise translate to simulate movement of the symbols on the display to the player. After the symbol configuration on the matrix display becomes static, the gaming machine evaluates the active pay lines for any winning combinations. At this point, the player may be provided with an opportunity to interchange at least one symbol for another. Thus, the player is given an opportunity to improve the combination of symbols for payout purposes. Also, since an interchange may affect multiple pay lines, perceivable gaming complexity is increased to preserve the interest of the player.

Symbol interchanges may be accomplished by any number of techniques. For example, two symbols may be selected via a touch screen and the symbols interchanged with no other effects on any other symbols. Alternatively, one or more symbols may be selected and then removed from the matrix display to allow the player to "move" another symbol vertically or horizontally into the open space for interchange, thereby creating another open space, similar to the classic Sam Lloyd "14–15 slide puzzle." More than one symbol may be movable, for example, two or three, to reconfigure the matrix display. The initial symbol that was removed from the matrix display may then be placed back into the final open space to recomplete the interchanged matrix display. Further, symbols may be interchanged within the matrix display under a protocol that constrains the movement of the symbols in some manner. For instance, a symbol may be selected by the player but constrained to move along certain directions. Specifically, in the case of a matrix display organization, the symbol selected for movement may be constrained to move horizontally, vertically, or both, while maintaining the relative positions of any adjacent symbols along the column or row including the selected symbol during movement. Other partially constrained alternative interchanging systems are also contemplated by the present invention, which is not limited to any of the exemplary interchanging formats disclosed herein. As used herein, the term "interchange symbols" encompasses transposition of two or more symbols, removal and replacement of symbols, movement of symbols, alone or in combination with adjacent symbols, and combinations thereof. Retrieval of a symbol from an external source to replace a symbol is also encompassed by the present invention.

The opportunity to interchange a symbol may be predetermined as a part of an initial game configuration responsive to placement of a primary wager, or may be otherwise obtained by the player via one or more additional wagers. Alternatively, generation of a certain configuration of symbols or the appearance of a certain selected symbol or combination of symbols on the matrix display may be used to invoke at least one opportunity to interchange at least one symbol. In addition, multiple interchanges after a play sequence but before a subsequent play sequence may be offered. Also, opportunities to interchange symbols may be accumulated through multiple plays of the game for use in a subsequent game, thus providing incentive for a player to continue playing as well as providing an increased opportunity for a player to configure one or more winning combinations.

In another aspect of the present invention, the amount of time provided within which to interchange or move a symbol may be limited. As the play sequence ends and the static symbol configuration has been communicated to the player on the matrix display, a timer may appear with a countdown clock for indicating the amount of time available for symbol interchanging. Inception of the matrix display of the symbols may be used to start the timer. The player now has a limited time to evaluate the displayed symbols and to cause the interchange of symbols that provides the maximum payout. Of course, the payout may be dependent on the final group of symbols on more than one pay line, rendering the mental exercise more taxing and, thus, more entertaining.

Once an interchange is made, the gaming machine reevaluates the symbol configuration on the matrix display for the presence of winning combinations. If a limited time is afforded to effect a symbol interchange and the time expires without an interchange having been initiated, the player loses the chance for the symbol interchange, and the initial symbol configuration on the matrix display is evaluated for any winning combinations.

Symbol interchange possibilities or payouts related to interchanged symbol combinations may be limited. For instance, if a winning event occurs in the initial matrix display along an active pay line as a result of a play sequence, an interchange opportunity may not be granted to the player or the winning pay line may be used as a barrier across which symbols may not be interchanged. Also, symbol interchange may be limited to interchange between adjacent symbols, or between symbols in the same row or column. Further, payout may be limited after an interchange to a single pay line. Other limiting features may be employed to maintain predictability of the game in the context of probabilities and associated payout tables.

As used herein, the term "game of chance" includes and encompasses not only games having a totally random or arbitrary outcome, but also such games which also invite, permit or required some player input to the game having at least a potential for affecting a game outcome. Such player input is generally termed "skill" whether or not such input is, in actuality, beneficial in terms of game outcome. The present invention, by inviting player input for interchange of at least one symbol within a displayed arrangement of symbols after random generation of the arrangement, thus falls within the definition of a game of chance, despite the opportunity for player input to potentially modify an outcome of a game.

The foregoing and other features and advantages of the invention will become more readily apparent from the following detailed description of the disclosed embodiments, with reference to the drawings appended hereto.

DETAILED DESCRIPTION OF THE INVENTION

Figure 1:
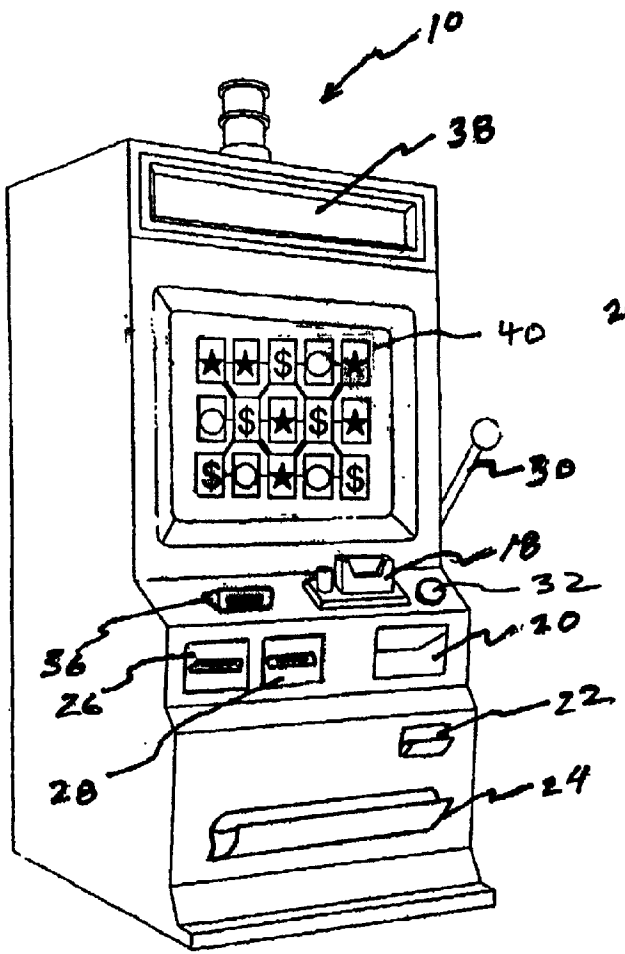
FIG. 1 is a perspective illustration of an exemplary gaming device which may be used to implement the present invention.

FIG. 1 illustrates an exemplary gaming device 10 which may be employed for play of games according to the present invention. The gaming device 10 as depicted is configured as an electronic video "slot machine," although the physical appearance of the machine housing and the illustrated features thereof are not intended as limiting of the present invention. For example, the present invention may be implemented on one or more remote gaming terminals linked to a centrally or peripherally located server, in the arrangement of a local area network (LAN), a wide area network (WAN) or even a secure real-time Internet or wireless connection.

Figure 3:
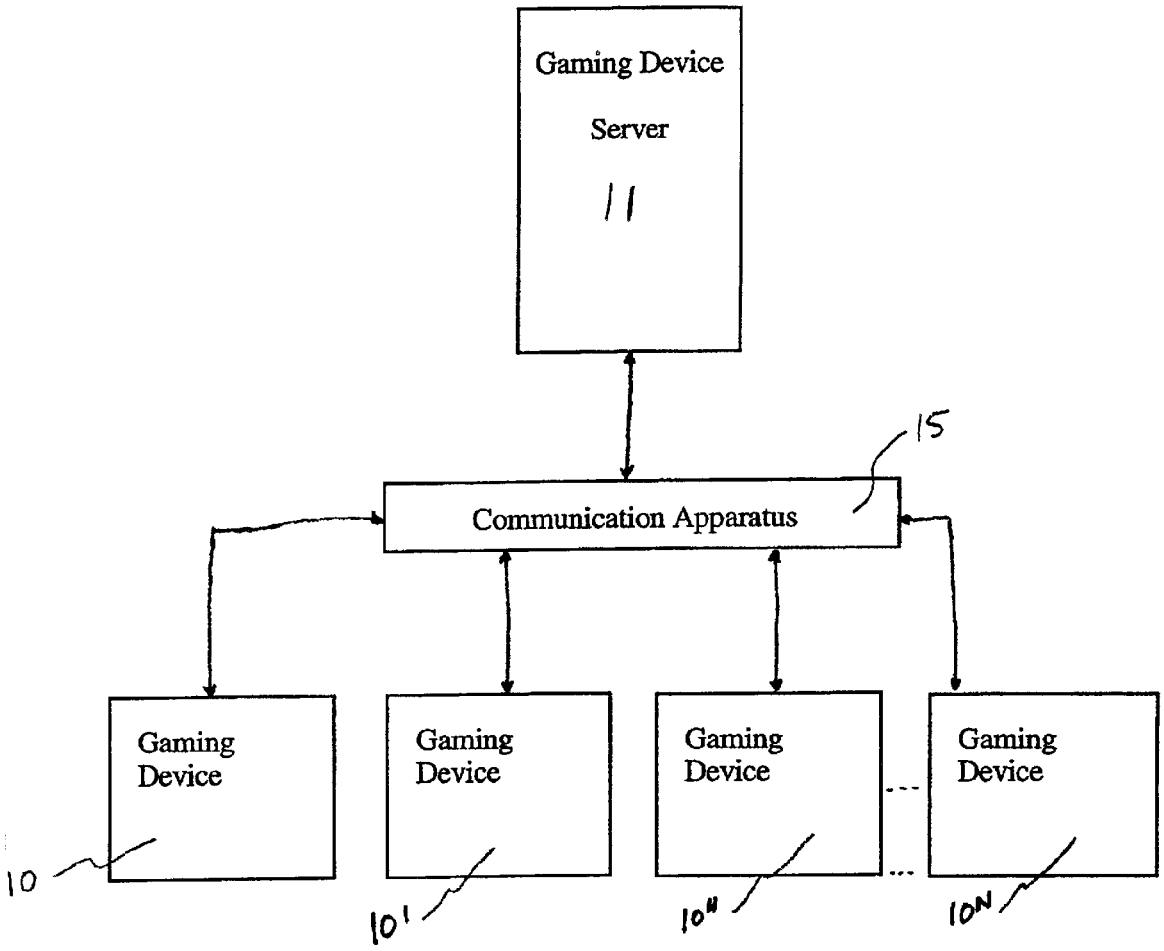
FIG. 3 is a schematic showing a plurality of networked gaming devices linked to another, central or otherwise remote gaming device for implementing one embodiment of the present invention.

FIG. 3 shows a networked, centrally configured gaming system of the present invention. The results of a play sequence may be transmitted to the centrally or peripherally located gaming device server 11 from each gaming device 10, 10', 10", $\mathbf{10}^N$ may be automatically sent to the centrally or peripherally located gaming device server 11 by the remote gaming devices 10, 10', 10", $\mathbf{10}^N$ for tracking, accounting and other processing. Communication apparatus 15 as shown between each gaming device 10, 10', 10", $\mathbf{10}^N$ and the centrally or peripherally located gaming device server 11 may be implemented, for example, through use of communication links known in the art. The communication apparatus may be tied to a casino intranet system, such as a LAN, or through use of a multi-property WAN. It is also contemplated that secure, such as encrypted, Internet or even wireless communication may be employed. The results (data) of a play sequence of each gaming device 10 in the form of one or more symbol configurations may be transferred, via a communication link or links, to each centrally or peripherally located gaming device server 11, as the generated symbol configuration is displayed on the pay line or pay lines of the player's remote gaming device 10 against criteria for winning combinations of symbols. One of ordinary skill in the art will appreciate that the centrally or peripherally located gaming device server 11 may also comprise a multi-processor, high-speed server programmed to generate symbol configurations for transmission to gaming devices 10', 10", $\mathbf{10}^N$, etc., responsive to play sequence initiation requests respectively received from gaming devices 10', 10", $\mathbf{10}^N$, etc., which are configured as "dummy" terminals having only limited electronics and programming sufficient to accept wagers, initiate play sequences and interchange symbols. Such an approach would be particularly suitable, by way of example only, for use with hand-held terminals carried by casino guests to outdoor recreation areas, bars and lounges, etc.

Figure 2:
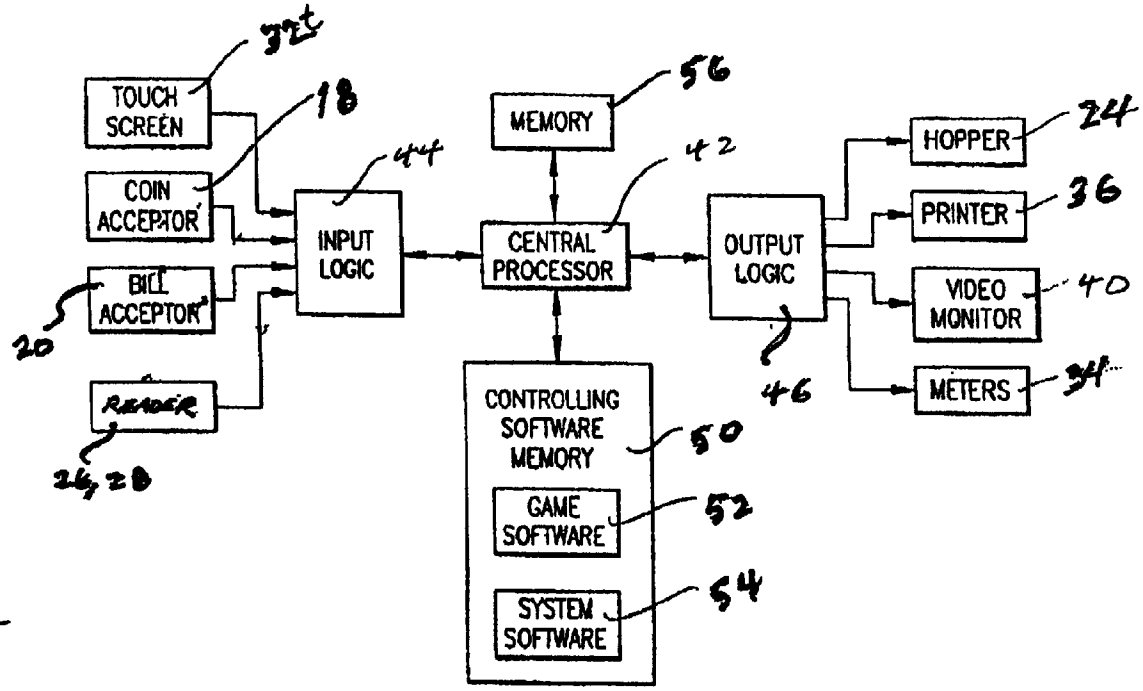
FIG. 2 is a block diagram of components which may be used in the gaming device of FIG. 1.

Turning again to FIG. 1, a gaming device 10 may include a display device in the form of a video monitor 40, which is configured for a visually perceptible matrix display of a plurality of symbols which may comprise, by way of example only and as known in the art, numbers, bars, fruit, medallions, stars and the like. Video monitor 40 may comprise an electronic video display such as a cathode ray tube (CRT) display, plasma display, field emission display (FED), liquid crystal display (LCD) or other suitable electronic video display known in the art. In an electronic video display implementation, the symbols, their identity, selection and configuration for display on the matrix display may be determined conventionally by a random number generator, while the visually perceptible "movement" thereof on the video monitor 40 may be determined conventionally by software driving and controlling the video monitor 40. Gaming device 10 may further include a coin acceptor 18 for receiving a wager in the form of one or more coins or tokens, a paper currency (bill) acceptor 20 including a bill validator, a change return 22 and a hopper 24 for rendering payouts in the form of coins or tokens. A player tracking card reader 26 and a credit/debit card reader 28 may also be included, as desired. A handle 30 or one or more buttons 32 may also be employed as initiator elements to initiate a game according to the present invention once a wager has been placed. Buttons 32 may comprise actual physical elements or the buttons may (as shown in FIG. 2) comprise one or more portions 32*t* of a "touch" screen display responsive to contact thereof by the player. Gaming device 10 may also incorporate one or more meter displays 34 (see FIG. 2), for example, displaying the amount of winnings, credit available for wagering, the number of plays accumulated, the number of symbol interchanges available, etc., and a printer 36 for generating a physical record of an award. Pay tables, attract sequences, or other game-associated information may also be displayed, as above video monitor 40, at 38, which may comprise a conventional illuminated glass or another video monitor, as known in the art.

Referring to FIG. 2, gaming device 10 may be provided with a central processor (CPU) 42 operably coupled to input logic circuitry 44 and output logic circuitry 46. Input logic circuitry 44 is employed to operably couple CPU 42 to input devices such as, for example, a touch screen segment 32*t* or physical button 32, coin acceptor 18, bill acceptor 20, player tracking card reader 26 or credit/debit card reader 28. Output logic circuitry 46 is employed to operably couple CPU 42 with output devices such as, for example, hopper 24, video monitor 40, meter displays 34 and printer 36. Video monitor 40 may, as previously noted, comprise a video display of any suitable type.

CPU 42 is also operably coupled to controlling software memory 50, which includes assigned memory locations storing game software 52 and system software 54. Such controlling software memory 50 dictates when selected graphics or messages are displayed to a player, as well as when play sequences begin and end and management of wager input and award output. CPU 42 is also operably coupled to a second memory 56, which is employed to store data indicative of game statistics, number of plays, number of wins, etc. Controlling software memory 50, second memory 56, or other, ancillary memory (not shown) may be used to store data indicative of winning results, such as data representative of one or more symbol combinations, including winning combinations. Second memory 56 may also be used, for example, to store a bit map of the symbol pattern depicted as a matrix display on video monitor 40.

As used herein, the term "gaming apparatus" contemplates and encompasses the operational portion of a gaming device for enabling, initiating and controlling the course of a game as well as components thereof, all as described above. A display or video monitor may be included within the term gaming apparatus, although such may be a separate component therefrom.

Figure 4:
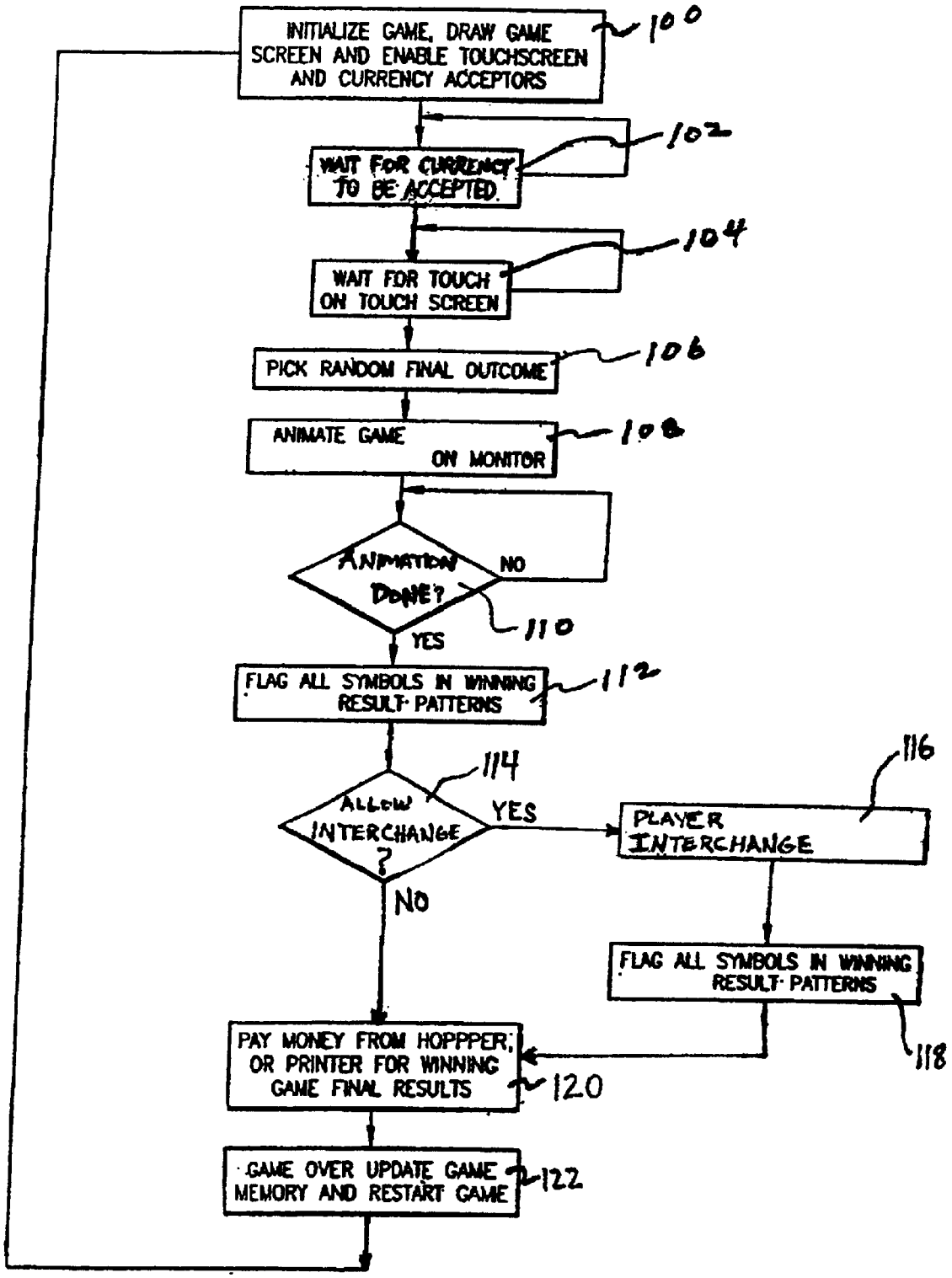
FIG. 4 is a flow chart illustrating an exemplary embodiment of the operation of a gaming device of the present invention.

Referring now to FIG. 4, the general operation of exemplary gaming device 10 will be described, including the operation of CPU 42 in combination with game software 52 and system software 54. Gaming device 10 is initialized at 100, as by a casino operator, responsive to which CPU 42 carries out instructions of system software 54 to implement an initial display pattern on video monitor 40 and to enable the input devices as previously mentioned. Gaming device 10 then remains in a passive or waiting state 102 until currency or the equivalent is input for a wager (for example, through the use of a credit card, debit card or player tracking card carrying a credit balance) and is validated by CPU 42 by way of the bill validator of bill acceptor 20, player tracking card reader 26 or debit/credit card reader 28. After a wager is received, gaming machine 10 is placed in a ready state 104 until a player activates an initiator element such as handle 30, physical button 32 or touch screen segment 32*t* to initiate a play sequence. At this point, the game software 52, in conjunction with a random number generator as known in the art, generates a random symbol configuration at 106 for a random final outcome comprised of a pattern of symbols for depiction on video monitor 40, as known in the art. System software 54 then animates the video monitor 40 at 108 by simulating the movement of visible representations of symbol carriers including symbols thereon so that the player perceives reel "movement." Once the visible representations of the symbol carriers have stopped 110, all of the generated, displayed symbols comprising a winning combination or combinations in the matrix display are identified or flagged 112. Each winning pay line may be, but is not necessarily, flagged on the display with a different color or other common link between all of the symbols included therein. Pay lines with winning combinations of symbols may have a line generated therethrough, the indicia on the winning pay line may be more brightly illuminated, the non-winning indicia reduced in brightness, or the winning combinations otherwise highlighted on the display as known in the art.

The CPU 42 determines, at 114, whether or not a symbol interchange is allowed, based on game-specific limitations or parameters. The player may then interchange symbols at 116 in the manner permitted by the game, as programmed. After symbol interchange, upon expiration of a time limit, or responsive to player input, at 118, any winning combination or combinations of symbols are identified or flagged. After an interchange opportunity has occurred, or if an interchange opportunity is not allowed, a payout may be generated at 120 in association with each winning pay line or combination of winning pay lines. When the game is over, the gaming device 10 resets at 122 for future play.

The manner in which winning combinations of symbols may be determined and flagged is well known in the art. The displayed results (pattern of symbols depicted on video monitor 40) is compared with data stored in game software 52 representing winning combinations to determine if any displayed combination on an active pay line is a winning combination. Any identified winning combination or combinations of symbols are then associated with winnings to be distributed to the player according to a pay table of the game software 52 associated with the various possible winning combinations. Thus, in the context of the present invention, the various pay line configurations and required combinations of the various indicia for a winning combination within each pay line reside within game software 52 and are retrieved for comparison to the randomly generated pattern of indicia depicted on video monitor 40.

Figure 5A:
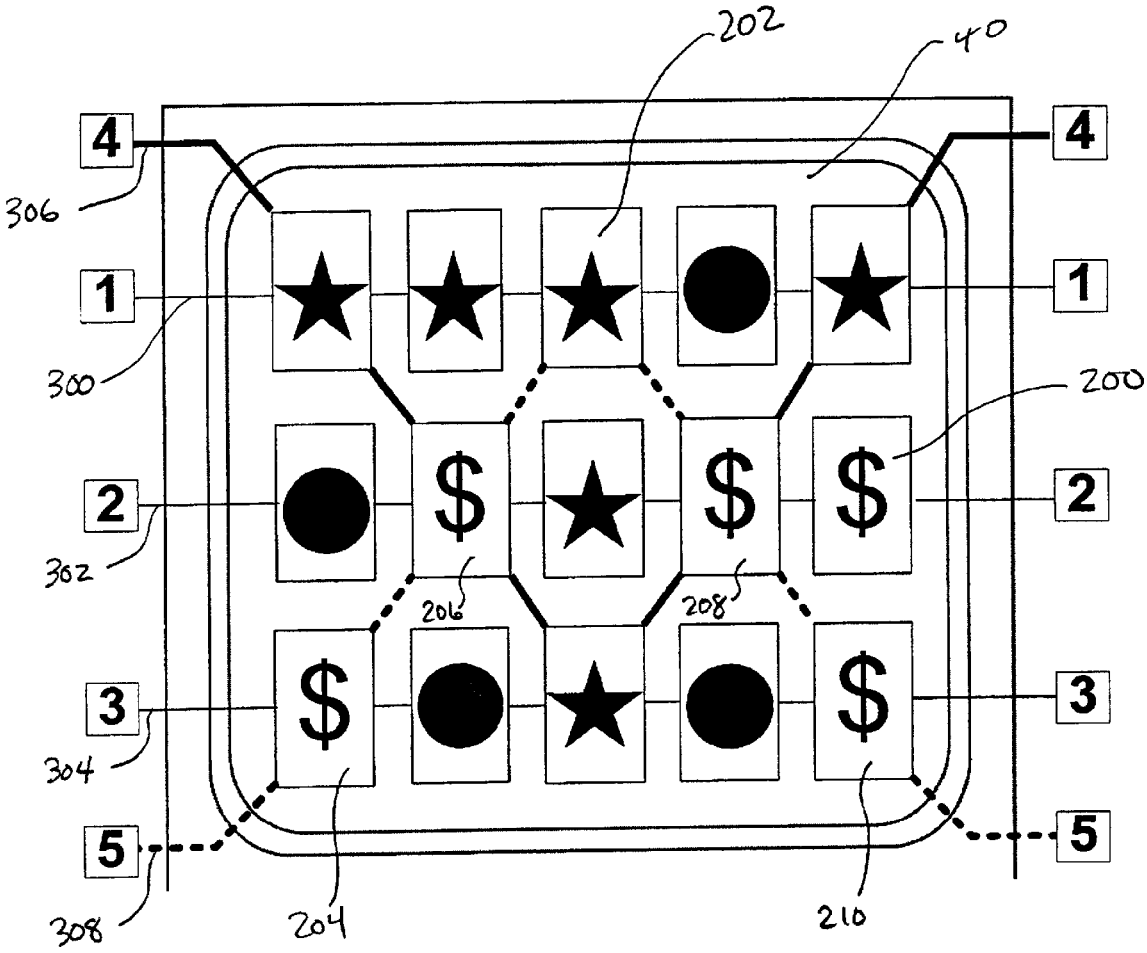
FIGS. 5A–5E comprise an exemplary depiction of the operation of a gaming device of the present invention.

Turning to the specific examples of implementation of the present invention, FIG. 5A shows a symbol configuration communicated to a player on a matrix display of a video monitor 40, thus ending a play sequence. Pay lines one 300, two 302, and three 304 are defined by horizontal lines extending across the five symbols of each row in the three by five matrix of symbols. Pay line four 306 is comprised of a multi-directional diagonal pay line formed from symbols 204, 206, 202, 208 and 210. Pay line five 308 is also comprised of a multi-directional diagonal pay line that is generally a mirror image of pay line four 306 with respect to horizontal pay line two 302.

Notably, pay line five 308 comprises four dollar sign symbols labeled 204, 206, 208, and 210, as well as one star symbol 202. Additionally, another dollar sign symbol 200 is present in the displayed symbol configuration along horizontal pay line two 302. It would be desirable, presuming by way of example that five of the same symbol along a pay line are a winning combination, to position dollar sign symbol 200 to occupy the position of star symbol 202, thus forming a combination of five dollar sign symbols along pay line 308.

Figure 5B:
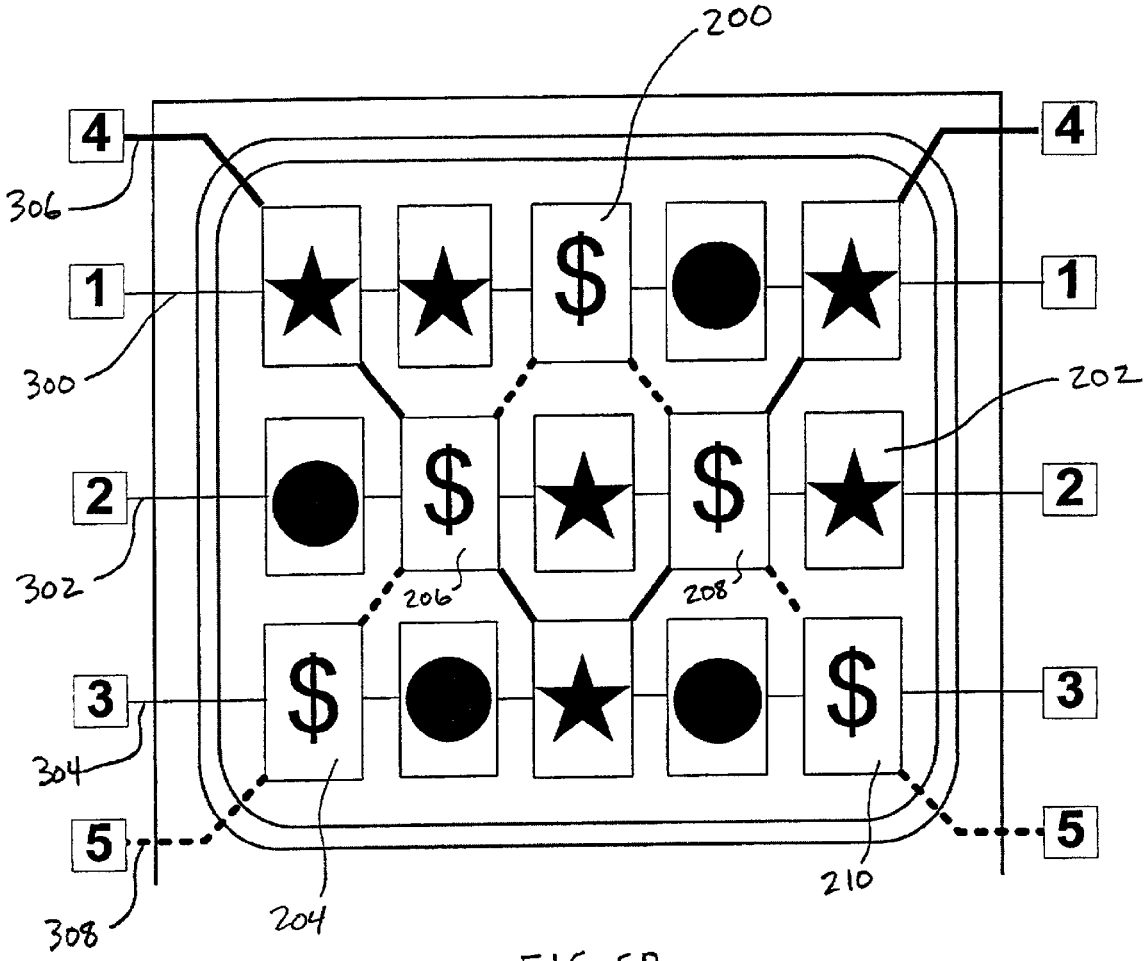

FIG. 5B shows the symbol configuration of FIG. 5A, except that dollar sign symbol 200 has been interchanged with star symbol 202 to form a winning combination of five dollar sign symbols 204, 206, 200, 208, and 210 along pay line five 308. Hence, the present invention may provide the opportunity to transform a play sequence into a more advantageous payout by way of symbol interchange.

The embodiment illustrated by FIGS. 5A and 5B suggests that a player may be free to choose and interchange the position of any two symbols displayed at the end of a play sequence. Other protocols for and constraints on interchanging of symbols are contemplated by the present invention. Significantly, the present invention is limited to positional interchanging of symbols that are displayed to the player at the end of a play sequence. However, symbol interchanging may be limited to fewer types of symbols than may be displayed at the end of a play sequence. As an example, referring to FIG. 5A, symbol interchanging may be provided between star symbols and dollar sign symbols only, thus excluding all circle symbols.

Similarly, additional limitations may be provided to limit the potential payout and increase the challenge of interchanging symbols for a player. One limitation may be to limit the symbol position(s) that are eligible to be interchanged so that only certain symbol positions are changeable. Also, interchanging may be limited to horizontally, vertically or diagonally adjacent interchanging. Further, multiple interchanging may be provided and tailored, according to the configuration of the gaming machine.

Figure 5D:
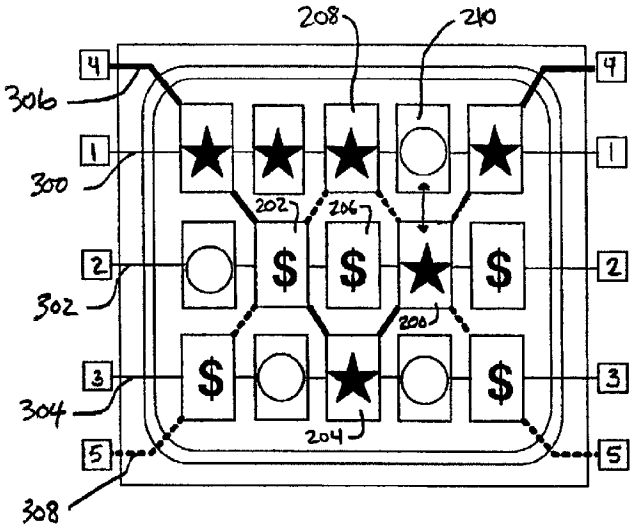
Figure 5C:
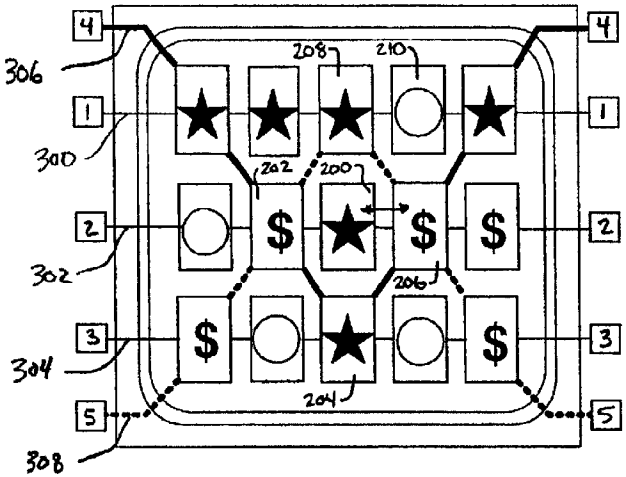
Figure 5E:
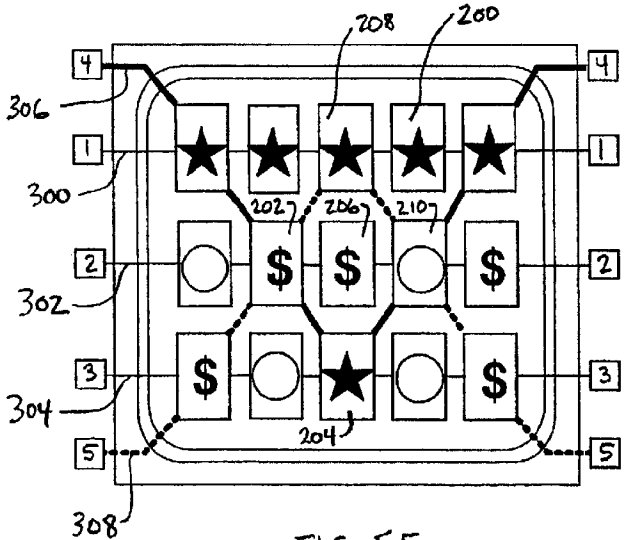

FIGS. 5C–5E illustrate a limited multiple symbol interchanging embodiment of the present invention. For example, the symbol configuration at the end of an exemplary play sequence is shown in FIG. 5C. However, symbol interchanging of this embodiment is limited to interchanging symbols that are horizontally or vertically adjacent, with only two interchanges allowed. Once two interchanges have been completed, the CPU 42 evaluates the symbol combinations along active pay lines to determine winning events. A timer may be employed to enhance and magnify the excitement of symbol interchanging by requiring a player to initiate any interchanging within a selected period of time. FIG. 5C shows the symbol configuration after star symbol 200 has been interchanged with horizontally adjacent dollar sign symbol 206, thus completing a first interchange. A final interchange (FIG. 5D) between star symbol 200 and circle symbol 210 produces five star symbols aligned along pay line one 300, forming an assumed (for purposes of this example) winning combination of symbols as shown in FIG. 5E.

Figure 6B:
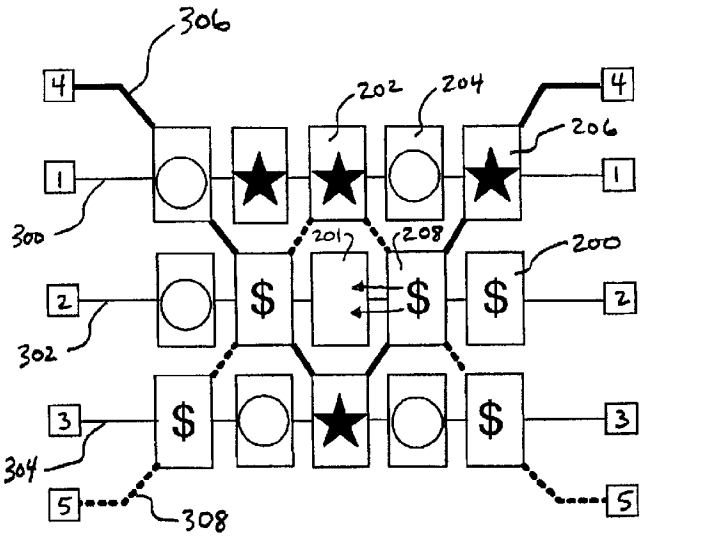
FIGS. 6A–6F comprise another exemplary depiction of the operation of a gaming device of the present invention.
Figure 6D:
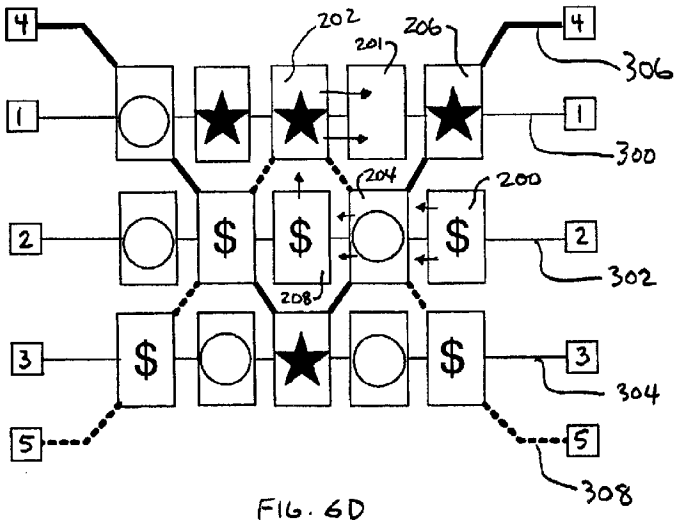
Figure 6A:
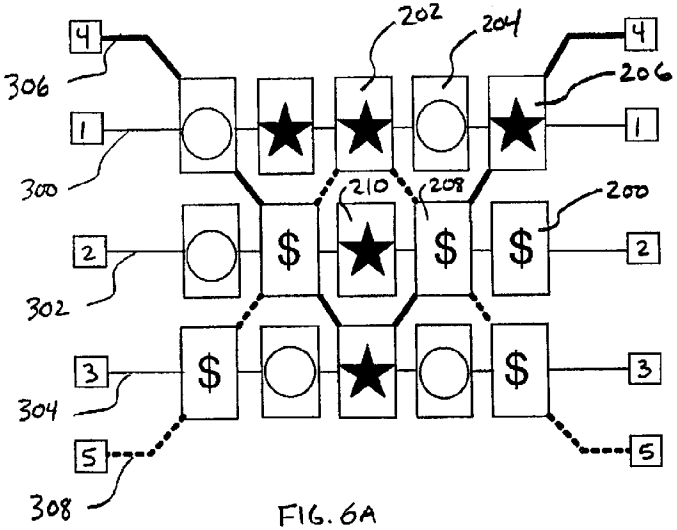

Another symbol interchanging embodiment is shown in FIGS. 6A–6F, wherein the player can play a type of "slide" game to interchange symbols appearing after a play sequence. FIG. 6A shows a symbol configuration displayed to a player on a matrix display at the end of a play sequence. In order to form a winning combination of symbols, the player may interchange symbols by way of a perceived slide-type movement. First, symbol 210 is removed from the symbol display temporarily. FIG. 6B shows that symbol 210 is no longer occupying a space within the symbol display, and open space 201 is shown instead.

Selection of the symbol that may be removed may be provided by the player, or might be based upon the wagers placed, or may be accomplished randomly. Further, it is contemplated that multiple symbols may be removed from the matrix display, and the corresponding spaces may be associated with the removed symbols. The player may be allowed to configure the symbol interchanging protocol to accommodate the level of interest and complexity desired.

Figure 6C:
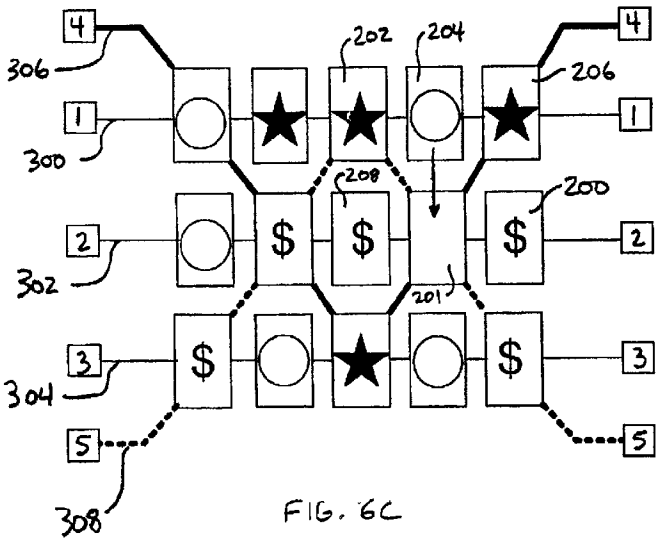
Figure 6F:
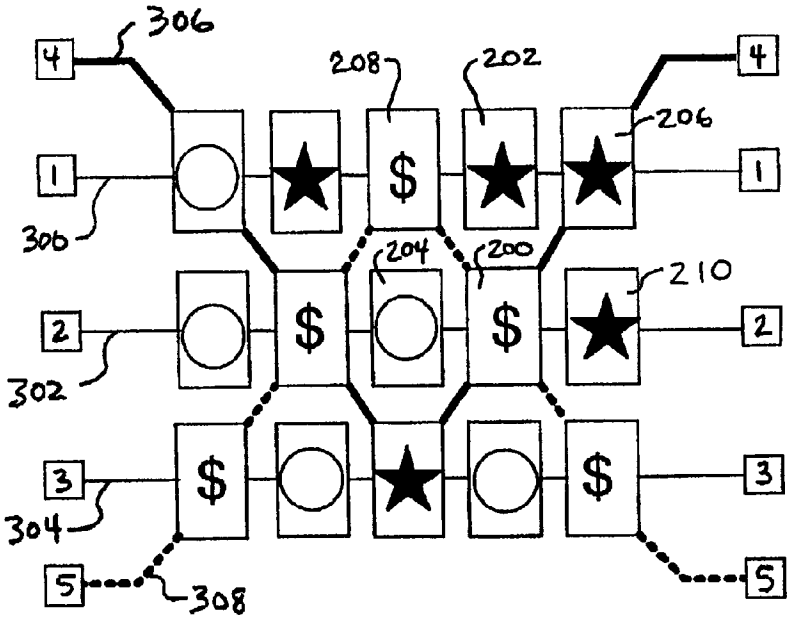
Figure 6E:
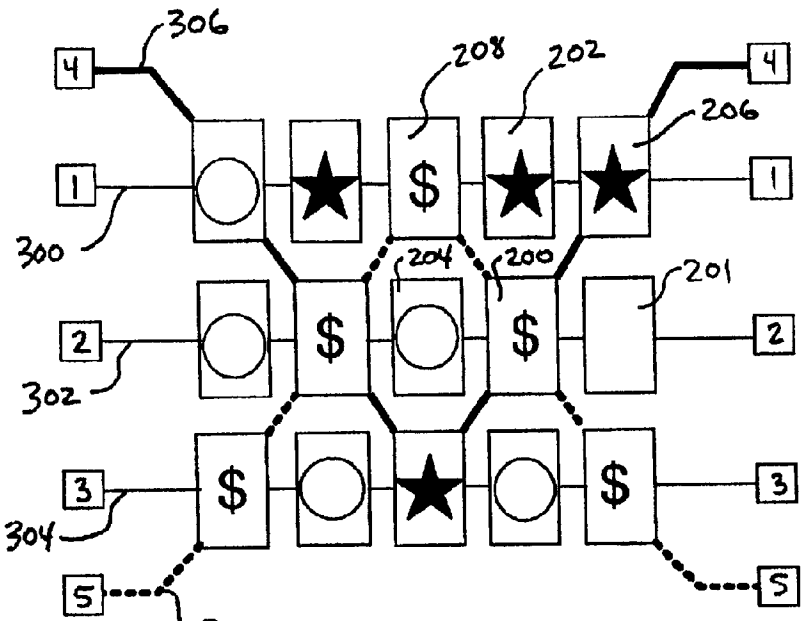

Continuing the example, symbol 208 is moved into the open space 201, as shown in FIG. 6C. Similarly, symbol 204 is moved into the open space 201 shown in FIG. 6C, thus creating the symbol configuration shown in FIG. 6D. A multiple symbol move is shown in FIG. 6D, where symbol 202 is moved into the open space 201; symbol 208 is then moved upward to occupy the space vacated by symbol 202; symbol 204 is moved into the center of the symbol configuration, into the space vacated by symbol 208; and symbol 200 is moved horizontally into the space vacated by symbol 204. The completed move and symbol configuration is shown in FIG. 6E, where the open space 201 is at the rightmost end of pay line two 302. Significantly, all the symbols along pay line five 308 are dollar signs; hence the interchanging as outlined above has formed an assumed winning combination of dollar sign symbols along the fifth pay line 308. Finally, FIG. 6F shows the completed symbol configuration, where removed symbol 210 is placed into the open space shown in FIG. 6E. The symbol configuration shown in FIG. 6F is then evaluated for winning symbol combinations and any corresponding payouts are delivered to the player. The removed symbol may optionally be placed back into the symbol configuration after player request, upon the expiration of a period clocked by a timer, after a number of symbol moves, or responsive to other criteria.

As a further implementation of the present invention, symbols may be interchanged along a perceptibly movable path. For instance, a row of symbols may be shifted along a horizontal row in a "wraparound" fashion, meaning that the symbol moving out of the border of the matrix display is moved into the matrix display on another side of the matrix display along the shift path. As an example, if the topmost horizontal row of symbols shown in FIG. 7A was displaced one symbol to the right, the rightmost symbol 208 would shift into the space occupied by symbol 200 before the shift and the other symbols would shift accordingly. Horizontal and vertical shift paths may be provided as well as diagonal shift paths, as the present invention is not limited to any particular shift path or wraparound configuration. In addition, shift paths may be comprised of a single line, or multiple lines. For instance, a protocol for interchanging the position of symbols may be configured so that a shift of a symbol causes a corresponding shift in several rows of the symbol configuration. Specifically, if the symbols of the topmost horizontal row shown in FIG. 7A were all displaced one symbol to the right, the lower horizontal row may be shifted to the right to accommodate symbol 208 into the space occupied by symbol 220 in FIG. 7A. Accordingly, symbol 228 would be displaced out of the symbol configuration and placed into the space vacated by symbol 200 upon shifting. Many interchanging systems are possible; the present invention is not limited to any one interchanging system.

Figure 7B:
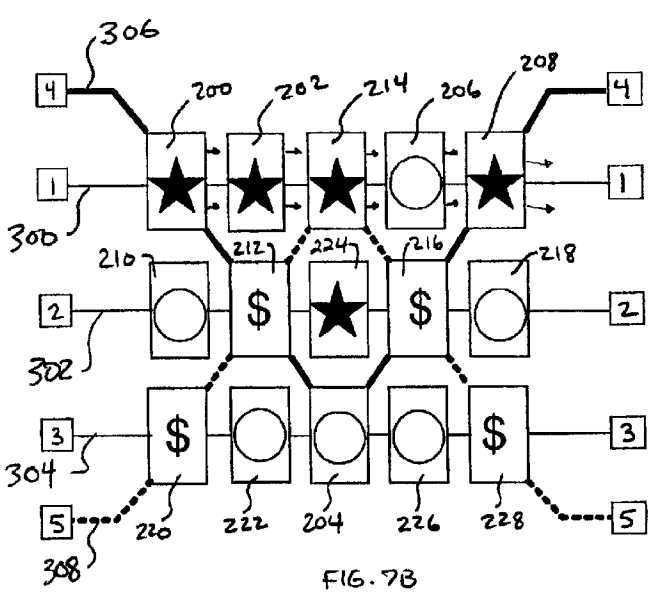
FIGS. 7A–7H comprise yet another exemplary depiction of the operation of a gaming device of the present invention.
Figure 7A:
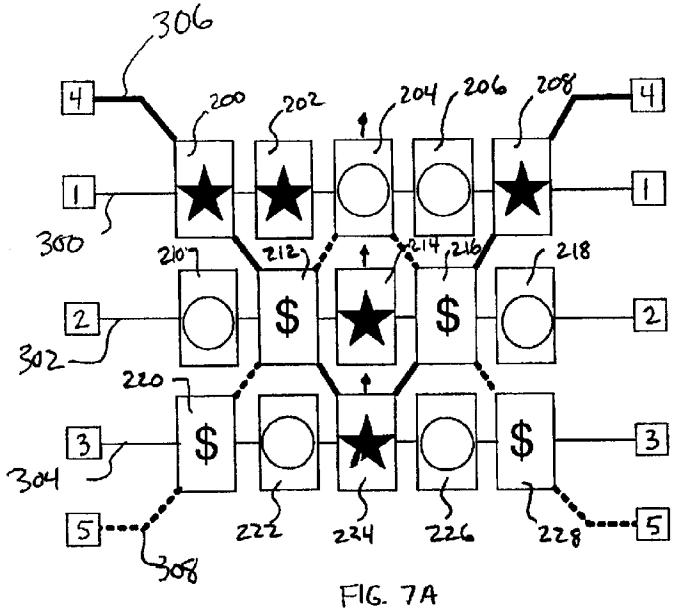
Figure 7D:
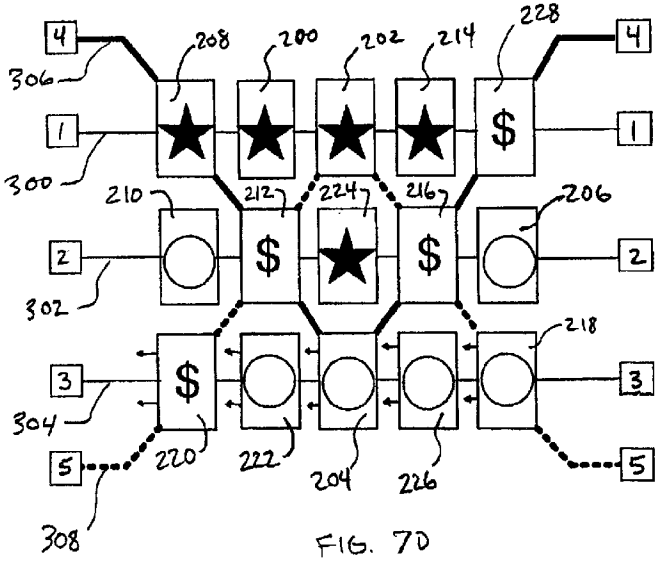
Figure 7C:
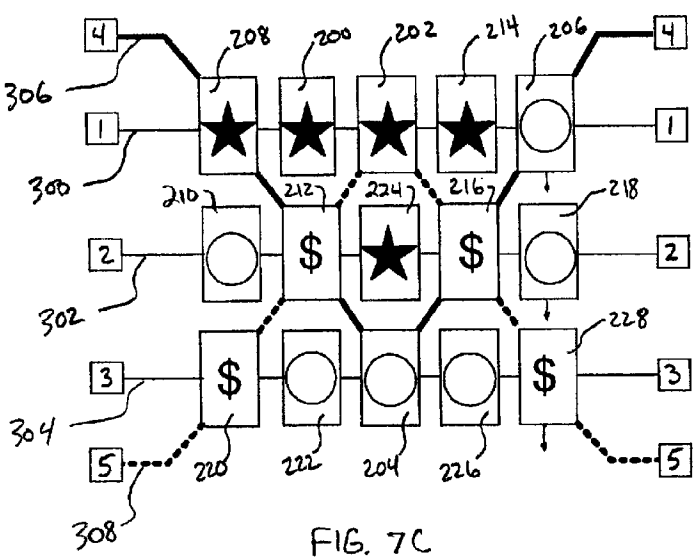
Figure 7E:
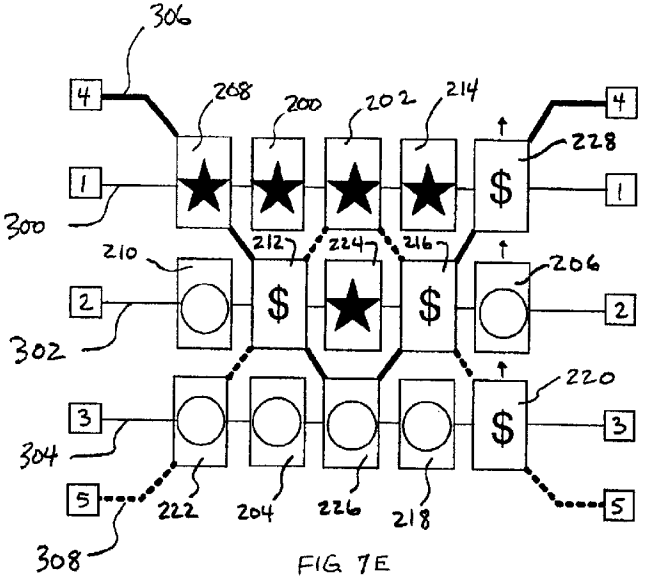
Figure 7F:
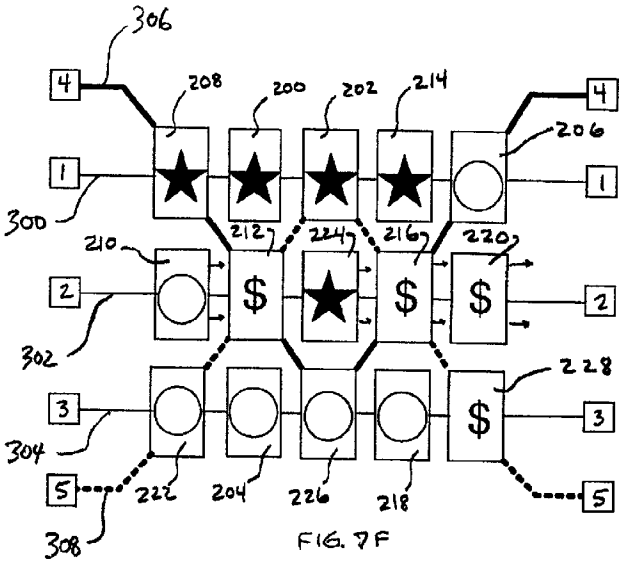
Figure 7G:
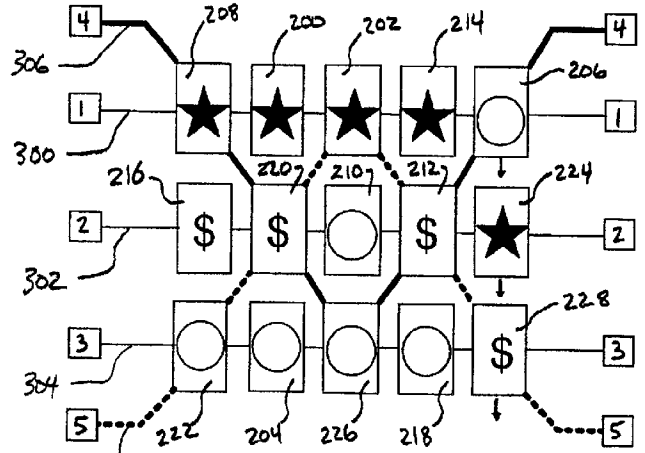
Figure 7H:
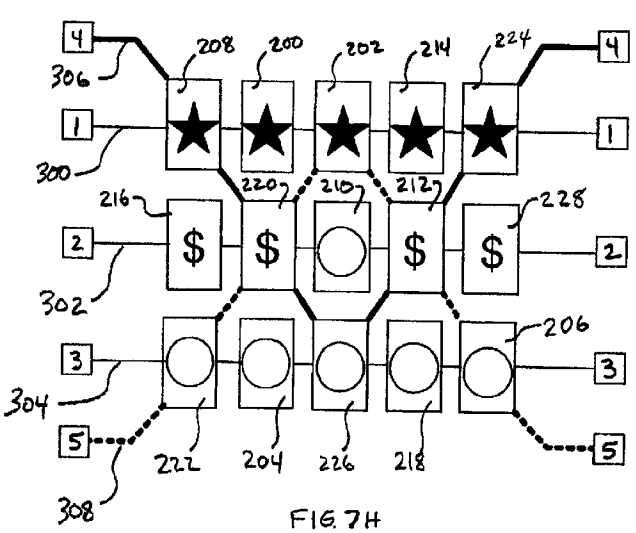

FIGS. 7A–7H illustrate a series of symbol interchanges along vertical and horizontal shift paths. First, an initial symbol configuration is shown in FIG. 7A as the ending configuration for a play sequence. The middle vertical column of symbols 204, 214, and 224 is shifted upward one symbol so that symbols 204, 214, and 224 occupy the positions shown in FIG. 7B. Next, the horizontal row of symbols along pay line one 300 is shifted one symbol to the right, as depicted by the arrows in FIG. 7B. Thus, the symbol configuration shown in FIG. 7C is formed. Further, the rightmost column of symbols comprising symbols 206, 218, and 228 may then be shifted downwardly one symbol to form the symbol configuration of FIG. 7D. Then, beginning with the symbol configuration shown in FIG. 7D, the bottommost horizontal row is displaced one symbol to the left to form the symbol configuration shown in FIG. 7E. The rightmost column of the symbol configuration of FIG. 7E may then be shifted upwardly one symbol to form the symbol configuration of FIG. 7F. Continuing, the middle row along pay line two 302 may be shifted two symbols to the right to form the symbol configuration shown in FIG. 7G. Finally, the rightmost column shown in FIG. 7G may be shifted downwardly two symbols to form the symbol configuration shown in FIG. 7H. Notably, pay line one 300 is now configured with five star symbols, 208, 200, 202, 214, and 224, while pay line three 304 is configured with five circle symbols, 222, 204, 226, 218, and 206. Each symbol configuration shown along pay line one 300 and pay line three 304 is assumed for the sake of this example to be a winning combination of symbols, thus allowing the player to transform an initial losing combination of symbols shown in FIG. 7A into the multiple winning pay lines of FIG. 7H.

The player may be given visual as well as audible indications of successful interchanging as well as visual and audible prompts to prevent inadvertent or impermissible interchanging under the rules of a particular implementation of the game. Upon selection of a symbol for interchanging, directional arrows may appear, providing indication of one or more permissible directions of shifting. Also, touch screens may be employed to literally provide a player with "hands on" control over interchanging.

As previously noted, a player may be afforded an opportunity to "buy" one or more symbol interchanges by placing a wager in addition to the conventional denomination of wager on the gaming machine to play the game of chance in question. For example, prior to commencement of a round of play on a one dollar machine, a player may add fifty cents to the primary wager to buy a symbol interchange opportunity or, of course, use credits already banked on the gaming machine. If no advantageous symbol interchange opportunity under established game parameters presents itself on the initially generated display the additional, or side, bet of fifty cents is lost. However, if such an opportunity is presented, the player may then effect the interchange. Similarly, and by way of example only, a maximum bet to cover all pay lines of a multiple pay line gaming machine may be required to enable a symbol interchange.

As mentioned hereinabove, the present invention is not limited to any specific protocols or constraints for symbol interchanging. For instance, symbol interchanging may be limited to certain rows and columns. One or more timers may also be employed to limit the available time that a player may use to shift one or more symbols and thereby reconfigure the symbols into a winning combination. Alternatively or additionally, permissible shift paths may be randomly chosen for the player and different permissible shift paths presented for each play of the game.

While the game of the present invention has been described in terms of a primary game of chance played on a stand-alone gaming machine, those of ordinary skill in the art will recognize that the game may be implemented as a bonus or secondary event in conjunction with play of a different, primary game, or may be offered as a bonus or secondary event enhancement of the same primary game which is played without the ability to interchange symbols unless and until one or more winning outcomes trigger play of a bonus mode of the primary game, enabling symbol interchange according to the present invention. Similarly, and as previously noted, a player may be enabled to win and "bank" a selected number of symbol interchange opportunities through repeated play of the game to one or more selected outcomes and implement a symbol interchange during one or more subsequent plays when potential pay line enhancement opportunities appear to be especially favorable. In such an instance, a certain rate of play or rate of wagering, or both, may be required to retain the symbol interchange opportunities in the bank for later use.

Further, the game of the present invention may be employed as a bonus or secondary event in a linked progressive configuration, wherein a portion of each wager at a plurality of networked gaming devices is allocated into an award pool for play of the game of the present invention as a bonus or secondary event.

In addition, it is contemplated that the game of the present invention may be played with networked gaming machines and symbols traded between gaming machines on the network or between a central server and each networked gaming machine. For example, each player in a bank of networked gaming machines may "discard" a symbol, which may be "retrieved" by the next player in time to reach the end of a game play sequence. Alternatively, a player at a given gaming machine may be permitted to "discard" a symbol on the video monitor of his or her gaming machine and to "retrieve" a randomly generated symbol made available by a central server to all of the networked gaming machines. In addition, the position of the symbol which might be discarded may be fixed (for example, the center symbol on a three-row, five-column symbol display) or may randomly vary with each game. Further, a player may enable a "discard" through generation of a potential winning combination during play of the game (for example, four out of five matching symbols on a pay line may enable a discard of the nonmatching symbol for retrieval of a potential match) or through placement of a side or supplemental wager, or a maximum wager for the game.

While the present invention has been described in terms of certain embodiments, it is not so limited, and those of ordinary skill in the art will readily recognize and appreciate that many additions, combinations, deletions and modifications to the embodiments described herein may be made without departing from the scope of the invention as hereinafter claimed.

What is claimed is:

1. A gaming apparatus for playing a slot game, comprising:

a housing;

a display unit that is capable of generating video images and associated with the housing;

an input device associated with the housing; and a controller operatively coupled to said display unit and said input device, said controller comprising a processor and a memory operatively coupled to said processor, said controller being programmed to allow the user to make a wager, said controller being programmed to cause a first video image to be generated on said display unit, said first video image representing the slot game and including a first arrangement comprising a plurality of symbols, said controller being programmed to allow the user to select a first symbol from any of the plurality of symbols and a second symbol from any of the plurality of symbols using the value input device, said controller being programmed to allow a user to interchange the position of the first symbol with the position of the second symbol to define a second arrangement of the plurality of symbols, said controller being programmed to allow the user to select a third symbol from any of the plurality of symbols, to retrieve a fourth symbol from an exterior source, and to replace the third symbol with the fourth symbol to get a third arrangement of the plurality of symbols, and said controller being programmed to determine a value payout associated with an outcome of said slot game based on the second arrangement.

2. The gaming apparatus of claim 1, wherein said first arrangement comprises a plurality of pay lines.

3. The gaming apparatus of claim 2, wherein said controller is programmed to activate a first number of pay lines of the plurality of pay lines.

4. The gaming apparatus of claim 3, wherein said controller is programmed to activate additional pay lines of the plurality of pay lines responsive to a wager placed.

5. The gaming apparatus of claim 1, wherein said controller is programmed to allow the user to at least temporarily remove the first symbol from the first arrangement.

6. The gaming apparatus of claim 5, wherein said controller is programmed to allow the user to move the second symbol into a position vacated by the first symbol.

7. The gaming apparatus of claim 1, wherein said controller is programmed to cause visually perceptible movement of the first symbol and the second symbol within the first arrangement in response to the interchange of the position of the first symbol and the position of the second symbol.

8. The gaming apparatus of claim 1, wherein the input device is a touch-sensitive input device disposed overlaying a portion of the display unit.

9. The gaming apparatus of claim 1, wherein the controller is programmed to permit the interchange of the position of the first symbol and the position of the second symbol only during a limited period of time.

10. The gaming apparatus of claim 1, wherein the controller is programmed to allow the user to interchange the position of the first symbol with the position of the second symbol responsive to at least one of the following events:

generation of at least one preselected symbol for display;

generation of at least one predetermined arrangement of symbols for display;

placement of a wager in excess of a preselected threshold; and accumulation of a plurality of selected outcomes during prior plays of the game.

11. The gaming apparatus of claim 1, wherein said controller is programmed to determine another value payout associated with an outcome of said slot game based on the third arrangement.

12. The gaming apparatus of claim 1, wherein said controller is located remotely to the housing and is operatively connected to the display unit and the input device via a telecommunication network.

13. The gaming apparatus of claim 12, wherein said telecommunication network is the Internet.

14. The gaming apparatus of claim 1, wherein the exterior source is at least one of a central server and another gaming device.

* * * * *